US008353421B2

(12) United States Patent
Rosazza et al.

(10) Patent No.: US 8,353,421 B2
(45) Date of Patent: Jan. 15, 2013

(54) CONTAINER WITH HINGE LID

(75) Inventors: Nicolas Rosazza, Cully (CH); Ashley Mark Salter, Chester (GB)

(73) Assignee: Philip Morris USA Inc., Richmond, VA (US)

( * ) Notice: Subject to any disclaimer, the term of this patent is extended or adjusted under 35 U.S.C. 154(b) by 317 days.

(21) Appl. No.: 12/631,475

(22) Filed: Dec. 4, 2009

(65) Prior Publication Data

US 2010/0193525 A1 Aug. 5, 2010

(30) Foreign Application Priority Data

Dec. 4, 2008 (EP) ..... 08253880

(51) Int. Cl.
*B65D 43/16* (2006.01)
*B65D 51/04* (2006.01)
*B65D 25/04* (2006.01)

(52) U.S. Cl. ..... 220/504; 220/524; 220/834; 220/847

(58) Field of Classification Search ..... 220/504, 220/524, 834, 835, 847
See application file for complete search history.

(56) References Cited

U.S. PATENT DOCUMENTS

| | | | | |
|---|---|---|---|---|
| 5,669,400 | A * | 9/1997 | Sheffler et al. | 132/295 |
| 5,709,232 | A * | 1/1998 | Sheffler et al. | 132/295 |
| 5,836,319 | A * | 11/1998 | Lombardi | 132/287 |
| 5,845,658 | A * | 12/1998 | Sussman | 132/287 |
| 6,044,973 | A | 4/2000 | Vasudeva | |
| 6,138,687 | A * | 10/2000 | Sheffler et al. | 132/295 |
| 6,162,516 | A | 12/2000 | Derr | |
| 6,196,412 | B1 * | 3/2001 | Cattell | 220/524 |
| 6,824,006 | B2 * | 11/2004 | Lambelet, Jr. | 220/835 |
| 7,124,883 | B1 * | 10/2006 | Thomas et al. | 206/256 |
| 2004/0089668 | A1 * | 5/2004 | Lambelet, Jr. | 220/835 |
| 2006/0060480 | A1 * | 3/2006 | Budd | 206/266 |
| 2006/0163188 | A1 * | 7/2006 | Lagler | 215/235 |
| 2007/0012711 | A1 * | 1/2007 | Kutsch et al. | 220/826 |
| 2009/0014450 | A1 * | 1/2009 | Bjorkholm | 220/521 |
| 2009/0084795 | A1 * | 4/2009 | Kagen | 220/505 |
| 2010/0078341 | A1 * | 4/2010 | Rasmussen et al. | 206/260 |

FOREIGN PATENT DOCUMENTS

| | | | |
|---|---|---|---|
| FR | 2 599 715 | A1 | 12/1987 |
| GB | 2 396 854 | A | 7/2004 |
| WO | WO 2005/016036 | A1 | 2/2005 |

OTHER PUBLICATIONS

International Preliminary Report on Patentability issued Jun. 7, 2011 for PCT/EP2009/008523.
European Search Report dated Apr. 9, 2009, in connection with Application No. 08253880.2-1261.
International Search Report and Written Opinion mailed Mar. 11, 2010 for PCT/EP2009/008523.

* cited by examiner

*Primary Examiner* — Mickey Yu
*Assistant Examiner* — Niki Eloshway
(74) *Attorney, Agent, or Firm* — Buchanan Ingersoll & Rooney PC

(57) ABSTRACT

A container includes a body portion having a side wall and a base wall, a first lid, and a second lid. The first lid is removably mounted to the side wall and the body portion and the first lid forms a first compartment. The second lids is connected to the body portion along a hinge and forms at least a part of the base of the container. The body portion and the second lid form a second compartment which is located on the opposite side of the base wall to the first compartment.

14 Claims, 2 Drawing Sheets

CONTAINER WITH HINGE LID

CROSS REFERENCE TO RELATED APPLICATION

This application claims priority to European Application No. 08253880.2, filed Dec. 4, 2008, the entire content of which is incorporated herein by this reference thereto.

BACKGROUND

Consumer items are commonly sold in boxes or tins having a box portion for housing the items, and a removable lid for closing the box portion. It has been proposed to provide a container for consumer items having an additional small compartment in the lid portion. For example, WO-A-2005/016036 discloses a box for snuff having a lid portion comprising a lower lid, which seals the portion of the box containing snuff, and a cover lid moveably secured to the lower lid by a hinged joint. The lower lid and the cover lid between them define a space, which is intended for the storage of used snuff. The cover lid is held in a closed position by means of a tab, which interacts with a corresponding part on the lower lid.

It would be desirable to provide a container having two or more separate compartments, each of which may be easily opened and closed. It would also be desirable to provide a container having two or more separate compartments, each of which is accessible independently from the other compartment or compartments. It would further be desirable if such a container could be simply manufactured and assembled.

The present invention relates to a novel container for consumer items. The container is particularly suitable for items that deliver oral sensations. More particularly, the container is suitable for flavor items for oral delivery of one or more selected flavorants, including tobacco.

SUMMARY OF SELECTED ASPECTS OF THE INVENTION

A container includes a body portion, a first lid, and a second lid. The body portion includes a side wall and a base wall. In a preferred embodiment, the body portion and the first lid form a first compartment and the first lid is removably attached to the side wall. Also preferably, the body portion and the second lid form a second compartment, and the second lid is connected to the body portion along a hinge such that the second lid forms at least a part of the base of the container. The first compartment and the second compartment are located on opposite sides of the base wall. Also preferably, the base wall includes a first portion forming a part of the base of the container. Moreover, the base wall includes a recessed portion, and the recessed portion and the second lid form the second compartment. Preferably, at least one of the first lid, the second lid, and the body portion have a circular cross-section. In the preferred embodiment, the first lid and the body portion have a circular cross-section and wherein the second lid has a semi-circular cross-section.

In the preferred embodiment, the hinge is created by an adhesive label connecting the second lid to the body portion. Also preferably, the hinge extends along an edge of the recessed portion of the base wall.

In the preferred embodiment, the container can also include retention means associated with at least one lid for locking the at least one lid in a closed position. The body portion of the container may also include a substantially transparent portion suitable for displaying the contents of at least one of the first and second compartments. In the preferred embodiment, the container includes snus pouches.

BRIEF DESCRIPTION OF THE DRAWINGS

The invention will be further described, by way of example only, with reference to the accompanying drawings, in which.

DETAILED DESCRIPTION

Figure 1:
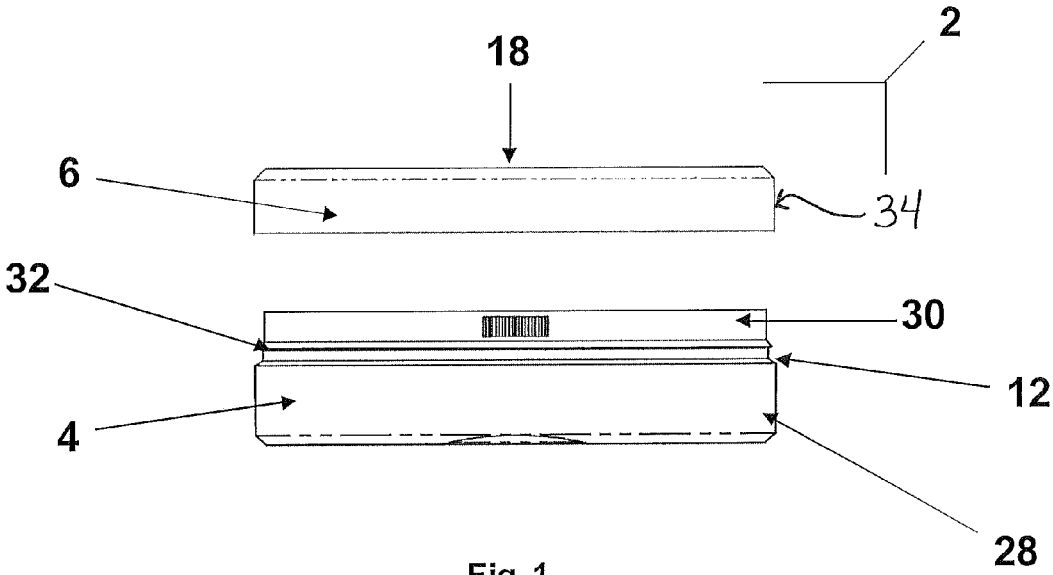
FIG. 1 shows a side view of a container according to the present invention, with the first lid separated from the body portion of the container.

In a preferred embodiment, a container includes a body portion having a side wall and a base wall, a first lid, and a second lid. The body portion and the first lid form a first compartment and the first lid is removably attached to the side wall. The body portion and the second lid form a second compartment and the second lid is connected to the body portion along a hinge and preferably forms at least a part of the base of the container. The first compartment and the second compartment are located on opposite sides of the base wall. Thus, the openings of the first and the second compartments are arranged on opposite sides of the container.

The arrangement of the lids on opposite sides of the base wall discourages the consumer from having both compartments open at the same time. With one compartment closed while the other is open, the risk of contaminating the consumer items, or mixing the items in the compartments, is decreased.

In the preferred embodiment, the first compartment and the second compartment are of a different size and have a different volume to each other. Particularly preferably, the first compartment is larger than the second compartment. In another embodiment, the first compartment and the second compartment may be of substantially the same size.

Also in the preferred embodiment, the first lid of the container is removable from the body portion. This means that when the first lid is opened in order to access the first compartment, the lid does not remain connected to the body portion, but is entirely separate, or detached from it. This may simplify the production and assembly process for the container, since it is not necessary to incorporate means for permanently connecting the first lid to the body portion.

In contrast, the second lid of containers is connected to the body portion along a hinge, so that it remains connected to the body portion in both the open and closed position. There is therefore no risk for any consumer item stored in the second compartment to be lost in a bag or pocket of clothing until the second lid is opened and the consumer items are disposed of.

As used herein, the term "hinge" refers to a line about which the second lid pivots relative to the body portion. The hinge may extend at least partway around the edge of the base of the container, but preferably, the hinge extends across the base of the container. The hinge may be provided by a line of weakness between the second lid and the body portion. For example, the second lid could be integral with the base wall of the body portion, or another part of the body portion. However, preferably, the second lid is formed separately to the remainder of the container and the hinge is provided by means of an adhesive label permanently or removably attached to the base of the container and connecting the second lid to the body portion of the container. This offers a simple and cost-effective way of providing the necessary hinge connection for the second lid. This may also simplify the production and assembly process for the container, since it is not necessary to incorporate means for permanently connecting the second lid to the body portion. Furthermore, the adhesive label may cover the second lid such that in its closed position, it is not visible.

In a closed position, the second lid forms at least a part of the base of the container. This is advantageous since the second lid does not protrude from the base of the container, so that the base of the container can remain substantially flat if desired. This enables the use of conventional apparatus and methods for packing the container. In addition, this construction means that if desired, the second lid can be made to be substantially invisible in the closed position, guaranteeing discretion.

The second lid may form all or a part of the base of the container. In a preferred embodiment, the second lid forms a part of the base of the container and the other part of the base of the container is formed by a first portion of the base wall of the body portion. In the closed position, the second lid is preferably flush with the first portion of the base wall.

In the preferred embodiment, the base wall of the body portion is surrounded on all sides by the side wall and may be of any desired shape, but is preferably circular. The base wall may consist of a single, planar wall which may be flat or curved. Alternatively, the base wall may provide a more complex surface that includes, for example, one or more recessed portions. By "recessed" is meant that the portion is inset from the base of the container.

In the preferred embodiment, the base wall includes a recessed portion which provides a base wall and optionally one or more side walls of the second compartment of the container. The recessed portion and the second lid therefore together form the second compartment.

The volume of the second compartment will depend upon the extent to which the base wall is recessed relative to the base of the container, as well as the area of the recessed portion. Since the base wall of the body portion provides a base wall for both the first compartment and the second compartment, an increase in the size of the second compartment will typically result in a corresponding decrease in the volume of the first compartment. The recessed portion of the base wall may be of any cross-section. However, where the container is of a circular cross-section, the recessed portion is preferably of a substantially semi-circular cross-section, thereby forming a second compartment having a semi-circular cross-section. In this case, the second lid is preferably of a corresponding, semi-circular cross-section. However, it may be of any cross-section, provided that the opening of the second compartment is covered when the second lid is in the closed position.

Preferably, where the second compartment is formed by the recessed portion of the base wall, the hinge along which the second lid is connected to the body portion extends along an edge of the recessed portion. Particularly preferably, the hinge extends between a first portion of the base wall forming a part of the base of the container and a second, recessed portion of the base wall.

The first lid and the second lid are preferably separate, that is, they are not attached or linked to each other in any way. The structure of the lids can therefore be relatively simple compared to the structure of the containers of the prior art, where the lids are connected to each other. One advantage of a simplified lid structure is that the manufacture and assembly processes may be further simplified and more efficient. A further advantage is that each lid can be more easily removed and replaced. Since the lids are not attached to each other, the risk of inadvertently opening one compartment while attempting to open the other compartment is also minimized.

The first and second lids may close the corresponding compartment by fitting over the side wall of the body portion, or by fitting within the side wall or base wall of the body portion. Where the second compartment is provided by a recessed portion of the base wall, as described above, the second lid may alternatively fit within the recessed portion.

Each lid preferably remains in a closed position until a positive force is applied by the consumer to open that lid and gain access to the corresponding compartment. This ensures that the lids are not inadvertently separated from the container between uses.

Advantageously, the first lid and the second lid may remain in the closed position due to the tight fit of the lid on or in the body portion and the friction between the contacting surfaces or edges of the lid and the walls of the body portion. For example, if the lid fits over the body portion, it may be provided with an inner cross-section of substantially the same shape and size as the outer cross-section of the body portion over which it fits. Alternatively, if the lid fits within the opening of the corresponding compartment, it may be provided with an outer cross-section of substantially the same size and shape as the cross-section of that opening. Preferably, at least one of the contacting surfaces is a high friction surface. For example, at least one of the contacting surfaces may be roughened compared to the remaining surfaces of the container.

Alternatively, or in addition, at least one of the first lid and second lid further includes retention means for locking that lid in the closed position. The retention means may be provided on the body portion, or the lid, or both the body portion and the lid. The retention means may be provided for one, or both of the lids. Where the retention means are provided for both lids the first lid and the second lid may be provided with the same or different retention means.

The retention means may include, for example, one or more annular flanges on one of the contacting surfaces, which engages with one or more correspondingly positioned grooves on the other contacting surface. With this type of retention means, the lid can be removed from the container by pulling the lid away from the rest of the container in order to disengage the flange from the groove.

In the preferred embodiment, the contacting surfaces of the first lid and the body portion are provided with corresponding screw threads which engage with each other when the first lid is closed. The screw threads may be single helical threads, or alternatively may be provided by at least two circumferentially spaced apart portions of a screw thread.

The side wall of the body portion may consist of one surface, for example, surrounding a circular base wall. Alternatively, the side wall may include a number of discrete surfaces, for example, three for a triangular base wall or four for a rectangular base wall. The side walls may be substantially perpendicular to the base wall. Alternatively, the side wall may be inclined towards or away from the base wall, for example if the container is tapered in the direction perpendicular to the base wall.

In the preferred embodiment, the base wall is formed of a single sheet of material that has been molded to the desired shape. Even more preferably, the base wall and the side wall are integrally formed from a single molded piece of material. This simplifies the process and apparatus required for forming the body portion of containers as described herein.

It will typically be possible to distinguish the first lid from the second lid by means of their different construction, or shape, or both. However, optionally, the container may include additional means for distinguishing the first lid from the second lid. For example, the lids may be of different colour, or the container may be printed, embossed or otherwise marked with indicia to indicate which compartment contains which type of two possible consumer items. This is particularly useful where one of the compartments is intended to store used consumer items, whereas the other compartment is intended to store fresh or non-used consumer items.

Containers are preferably substantially cylindrical in shape, with the body portion and first lid having a substantially circular outer cross-section. Alternatively, the containers may be substantially prismatic or pyramidal in shape with, for example, a substantially triangular, rectangular or oval cross-section. Preferably, the height of the first lid is about a third of the height of the entire closed container.

Containers may be formed from any suitable materials including, but not limited to cardboard, plastic, metal or combinations thereof. The body portion may be formed from a different material to the lids, or the body portion and lids may all be formed from the same material. The first and second lid each may be formed from a different material or formed from the same material. For example, in a preferred embodiment, the body portion and the second lid are made from molded plastic, while the first lid is made of metal.

Preferably, the body portion includes a substantially transparent portion for viewing the contents of at least one of the first and second compartments. This allows one to see how many of the consumer items remain in the container, without the need to remove the lid. In a preferred embodiment, the body portion is made from a substantially transparent plastic material. Preferably, the body portion of the container is injection molded from a material selected from the group consisting of polypropylene, polyethylene, polystyrene, nylon, polysulfone, polyester, polyurethane, and combinations thereof. Alternatively, the body portion may be made from glass.

The first and the second compartments of containers may be used to store consumer items that differ in flavor, colour or texture. Alternatively, one compartment may be used to store accessories for use in combination with the consumer items. In another embodiment, one compartment may be used to store discarded packaging material or used consumer items.

The container finds particular application as a container for the storage of products that deliver oral sensations. More particularly, the container is suitable for flavor items for oral delivery of one or more selected flavorants including tobacco. An example of a flavor item is a snus pouch. A snus pouch is a tobacco material encased in a pouch material, wherein the tobacco material may include tobacco, water and salt, as well as additives, such as non-tobacco flavorants and humectants. Other suitable flavor items include moist smokeless tobacco, molded tobacco pieces, tobacco tablets, and tobacco chews.

Advantageously, the provision of a second compartment enables the temporary storage of used items in the container until it is possible to dispose of them appropriately. As the second compartment is separate from the first compartment and the compartments are closed by separate lids it is ensured that the unused items are not contaminated or otherwise adversely affected by the used items.

The container is preferably offered with the first compartment filled with the unused consumer items and the second compartment empty. In a particularly preferred embodiment, the first compartment is filled with flavor pouches and the second compartment is empty.

Once filled with the consumer items, the compartment housing the consumer items is preferably sealed in order to maintain freshness of the consumer items. For example, a plastic or foil layer may be sealed over the top edge of the first compartment. Preferably, such a sealing layer includes a tab, or other means for enabling the easy removal of the layer.

As shown in FIG. 1, FIG. 2, FIG. 3, and FIG. 4, the container 2 is substantially cylindrical in shape and includes a plastic body portion 4, a first metal lid 6 and a second plastic lid 8. The first lid 6 fits over the upper end of the body portion 4.

Figure 3:
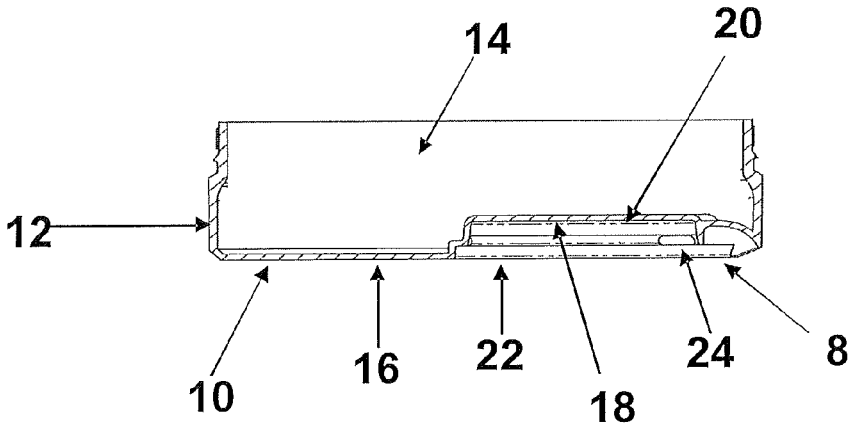
FIG. 3 shows a cross-sectional view of the container of FIG. 1 with the first lid removed from the container and the second lid in a closed position.
Figure 4:
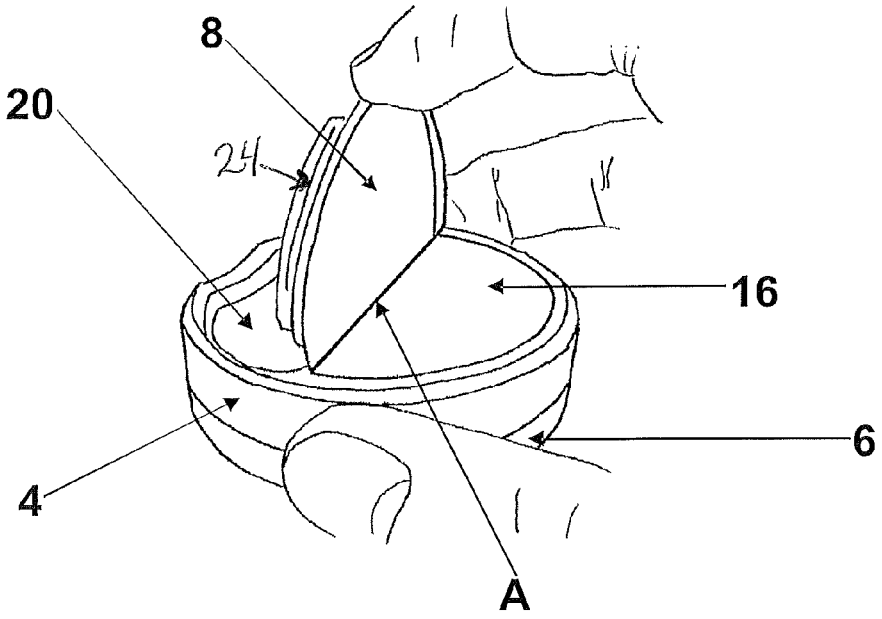
FIG. 4 shows a perspective view of the container of FIG. 1 with the second lid in an open position.

As shown in FIG. 3, the body portion 4 includes a generally circular base wall 10 and a generally annular side wall 12 extending generally perpendicularly in an upwards direction from the edge of the base wall 10. The base wall 10, the side wall 12 and the first lid 6 define a first compartment 14 having an opening at the upper side or end of the container 2.

The base wall 10 of the body portion (See FIG. 4) includes a first generally semi-circular portion 16 which forms about half of the base of the container 2 and a second generally semi-circular portion 18 that is recessed relative to the first portion 16 and the base of the container 2 to provide a generally semi-circular recess at the lower side of the container. The semi-circular recess includes a base wall, a substantially straight side wall and a generally curved side wall, all of which are provided by the base wall of the body portion 10. The recessed portion 18 of the base wall 10 and the second lid 8 together define a second compartment 20, which is significantly smaller than the first compartment 14.

As shown in FIG. 1, the first lid 6 includes a generally circular top wall 18 and a generally annular side wall 34 extending generally perpendicularly from the peripheral edge of the top wall 18. When fitted over the side wall 12 of the body portion 4, the first lid 6 closes the first compartment 14 (See FIG. 3).

Figure 2:
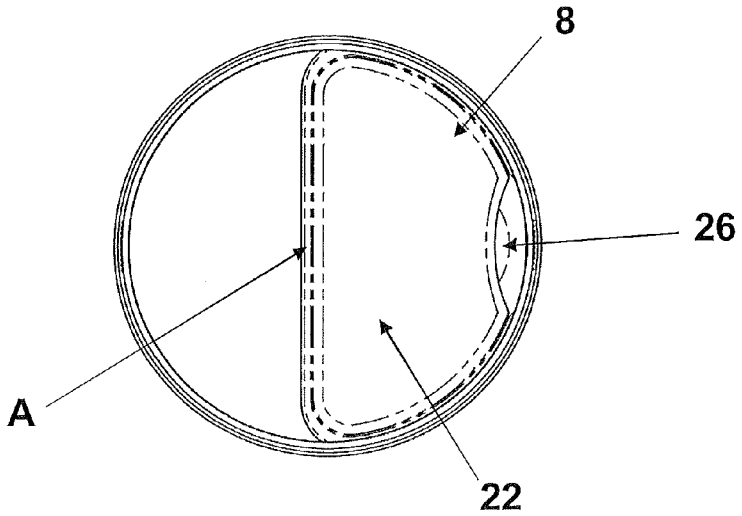
FIG. 2 shows a bottom view of the container of FIG. 1.

As shown in FIG. 2 and FIG. 3, the second lid 8 consists of a bottom wall 22 which is substantially semi-circular in shape and a semi-annular side wall 24 extending from the bottom wall 22 at a small distance from the semi-circular edge thereof. The second lid 8 fits over the opening of the second compartment 20 so that, when closed, it lies flush with the first portion 16 of the base wall 10. The first portion 16 of the base wall 10 and the second lid 8 together form the base of the container 2. In the closed position, the semi-annular side wall 24 of the second lid 8 lies inside the second compartment 20 and engages with the curved side wall of the recessed portion 18 of the base wall 10 in order to keep the second lid 8 in a closed position until a positive force is applied.

In the preferred embodiment, the second lid 8 includes a cut out 26 in the curved edge thereof, which facilitates the opening of the lid 8 during use. As can be seen from FIG. 3, the recessed portion 18 of the base wall 10 is shaped to take into account the presence of the cut out 26 in the second lid 8 such that the second compartment 20 is completely closed by the second lid 8.

In the preferred embodiment, a substantially circular adhesive label may be applied to the base of the container 2 over the first portion 16 of the base wall and the base wall 22 of the second lid 8. The label connects the second lid 8 to the remainder of the container 2 and provides a hinge "A" (shown in FIG. 2) across the center of the base, about which the second lid 8 may be pivoted in order to open and close the second compartment 20. The label preferably includes a cut out corresponding in size to that provided in the second lid and the label is applied so that the cut outs in the label and second lid are aligned with each other.

As can be seen from FIG. 1, the side wall 12 of the body portion 4 includes a lower generally annular portion 28 and an upper, recessed generally annular portion 30 above the lower annular portion 28. The lower annular portion 28 remains visible when the first lid 6 is in place.

The upper, recessed annular portion 30 has a reduced diameter compared to the lower annular portion 28. The difference in diameter between the lower annular portion 28 and the upper annular portion 30 is approximately equal to the thickness of the side wall 34 of the first lid 6. Thus, when the first lid 6 is in place on the body portion 4, the side wall 34 thereof overlies the upper annular portion 30 of the side wall 12 of the body portion 4. In this closed position, the side wall 34 of the lid 6 is substantially flush with the lower annular portion 28 of the side wall 12 of the body portion 4.

As can be seen from FIG. 1, the upper, recessed annular portion 30 of the side wall 12 of the body portion includes an annular flange, or projection 32 extending circumferentially around the body portion 4. The first lid 6 includes an annular flange, or lip, at the edge of the side wall 34 thereof, which engages with the flange 32 on the body portion 4 to retain the first lid 6 in the closed position. In order to remove the first lid 6, it must be pulled upwards away from the body portion 4, in order to disengage the annular flange on the first lid 6 from that on the body portion 4.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions. In this connection, the term "curved" is intended to also include configurations comprising two or more substantially straight line segments describing the "curved" feature.

While the foregoing describes in detail a preferred a container with a hinge lid and methods of making the container with reference to a specific embodiment thereof, it will be apparent to one skilled in the art that various changes and modifications may be made to the container and equivalent methods may be employed, which do not materially depart from the spirit and scope of the foregoing description. Accordingly, all such changes, modifications, and equivalents that fall within the spirit and scope of the appended claims are intended to be encompassed thereby.

We claim:

1. A container comprising:

a body portion having a side wall and a base wall;

a first lid, wherein the body portion and the first lid form a first compartment and wherein the first lid is removably mounted to the side wall; and a second lid including a bottom wall, a semi-annular side wall extending from the bottom wall and a cut out in the bottom wall and semi-annular side wall operable to facilitate opening of the second lid during use, wherein the body portion and the second lid form a second compartment, wherein the second lid is connected to the body portion along a hinge and forms at least a part of the base of the container, wherein the first compartment and the second compartment are located on opposite sides of the base wall, wherein the hinge is created by an adhesive label connecting the second lid to the body portion, and wherein the base wall is circular and the side wall extends upwardly from the base wall and the adhesive label is circular and covers a semicircular section of the base wall and the bottom wall of the second lid.

2. The container of claim 1, wherein the base wall comprises a first portion forming a part of a container base extending inwardly from a lower end of the side wall and the remainder of the base wall extends inwardly from the side wall at a location above the lower end of the side wall.

3. The container of claim 1, wherein the base wall comprises a recessed portion and wherein the recessed portion and the second lid form the second compartment.

4. The container of claim 1, wherein the hinge extends along an edge of a recessed portion of the base wall.

5. The container of claim 1, further including retention means associated with at least one lid for retaining the at least one lid in a closed position.

6. The container of claim 1, wherein the body portion further includes a substantially transparent portion suitable for displaying the contents of at least one of the first and second compartments.

7. The container of claim 1, wherein the first lid has a generally circular cross-section.

8. The container of claim 7, wherein the first lid and the body portion have a generally circular cross-section and wherein the second lid has a generally semi-circular cross-section.

9. The container of claim 1, wherein the container includes snus pouches.

10. The container of claim 1, wherein the bottom wall of the second lid lies flush with a semicircular portion of the base wall when in a closed position.

11. A container comprising:

a body portion having a side wall and a base wall;

a first lid, wherein the body portion and the first lid form a first compartment and wherein the first lid is removably mounted to the side wall; and a second lid including a bottom wall, a semi-annular side wall extending from the bottom wall and a cut out in the bottom wall and semi-annular side wall operable to facilitate opening of the second lid during use, wherein the body portion and the second lid form a second compartment, the second lid is connected to the body portion along a hinge and forms at least a part of the base of the container, the first compartment and the second compartment are located on opposite sides of the base wall, the hinge is created by an adhesive label connecting the second lid to the body portion, the base wall comprises a first portion forming a part of a container base extending inwardly from a lower end of the side wall and the remainder of the base wall extends inwardly from the side wall at a location above the lower end of the side wall, the base wall comprises a recessed portion, the recessed portion and the second lid form the second compartment, the hinge extends along an edge of the recessed portion of the base wall, the first lid and the body portion have a generally circular cross-section, the second lid has a generally semi-circular cross-section, the base wall is circular and the side wall extends upwardly from the base wall and the adhesive label is circular and covers a semicircular section of the base wall and the bottom wall of the second lid, and the bottom wall of the second lid lies flush with a semicircular portion of the base wall when in a closed position.

12. The container of claim 11, further including retention means associated with at least one lid for retaining the at least one lid in a closed position.

13. The container of claim 11, wherein the body portion further includes a substantially transparent portion suitable for displaying the contents of at least one of the first and second compartments.

14. The container of claim 11, wherein the container includes snus pouches.

* * * * *